US011480124B2

(12) United States Patent
Ikeda et al.

(10) Patent No.: US 11,480,124 B2
(45) Date of Patent: Oct. 25, 2022

(54) CONTROL APPARATUS FOR INTERNAL COMBUSTION ENGINE

(71) Applicant: TOYOTA JIDOSHA KABUSHIKI KAISHA, Aichi-ken (JP)

(72) Inventors: Yuto Ikeda, Okazaki (JP); Yuki Nose, Nagoya (JP); Takanobu Gotoh, Obu (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 17/583,204

(22) Filed: Jan. 25, 2022

(65) Prior Publication Data

US 2022/0268231 A1 Aug. 25, 2022

(30) Foreign Application Priority Data

Feb. 24, 2021 (JP) ..... JP2021-027701

(51) Int. Cl.

| | |
|---|---|
| ***F02D 41/00*** | (2006.01) |
| ***F02D 41/04*** | (2006.01) |
| ***F02D 41/14*** | (2006.01) |
| ***F02D 41/02*** | (2006.01) |
| ***F02D 41/38*** | (2006.01) |
| ***F02D 41/12*** | (2006.01) |

(52) U.S. Cl.

CPC ..... *F02D 41/1475* (2013.01); *F02D 41/0087* (2013.01); *F02D 41/0255* (2013.01); *F02D 41/047* (2013.01); *F02D 41/123* (2013.01); *F02D 41/1454* (2013.01); *F02D 41/38* (2013.01)

(58) Field of Classification Search

CPC .. F02D 41/0087; F02D 41/047; F02D 41/123; F02D 41/1454

USPC ..... 123/198 F, 481, 491, 685, 686, 689

See application file for complete search history.

(56) References Cited

U.S. PATENT DOCUMENTS

| | | | | |
|---|---|---|---|---|
| 5,765,533 | A * | 6/1998 | Nakajima | F02D 41/0087 123/492 |
| 2005/0166900 | A1* | 8/2005 | Song | F02D 41/047 123/481 |
| 2005/0205037 | A1* | 9/2005 | Lewis | F02D 13/0215 123/179.16 |

(Continued)

FOREIGN PATENT DOCUMENTS

| | | | |
|---|---|---|---|
| JP | H5141294 | A | 6/1993 |
| JP | 2007146826 | A | 6/2007 |

*Primary Examiner* — Erick R Solis

(74) *Attorney, Agent, or Firm* — Hauptman Ham, LLP

(57) ABSTRACT

A CPU increases an injection amount when a coolant temperature of an internal combustion engine is equal to or lower than a predetermined temperature. The CPU corrects the injection amount to control an air-fuel ratio to a target value in a feedback manner. The CPU performs a temperature raising process for a GPF, by stopping fuel injection in a second cylinder and making the air-fuel ratio of an air-fuel mixture in first, third, and fourth cylinders richer than a theoretical air-fuel ratio. In performing the temperature raising process, the CPU stops a feedback process of the air-fuel ratio. In performing the temperature raising process, the CPU corrects the injection amount in a decreasing manner in accordance with an operation amount of the feedback process before the performance of the temperature raising process.

7 Claims, 5 Drawing Sheets

(56) References Cited

U.S. PATENT DOCUMENTS

| | | | | |
|---|---|---|---|---|
| 2011/0030657 | A1* | 2/2011 | Tripathi | F02D 41/0087 123/481 |
| 2011/0197860 | A1* | 8/2011 | Aso | F02D 41/047 123/491 |
| 2019/0211761 | A1* | 7/2019 | Ranga | F02D 41/1401 |
| 2020/0309058 | A1* | 10/2020 | Sekita | F02D 41/047 |

* cited by examiner

CONTROL APPARATUS FOR INTERNAL COMBUSTION ENGINE

CROSS-REFERENCE TO RELATED APPLICATION

This application claims priority to Japanese Patent Application No. 2021-027701 filed on Feb. 24, 2021, incorporated herein by reference in its entirety.

BACKGROUND

Technical Field

The present disclosure relates to a control apparatus for an internal combustion engine.

Description of Related Art

For example in Japanese Unexamined Patent Application Publication No. 2007-146826 (JP 2007-146826 A), there is described a control apparatus that increases an amount of fuel injection for a predetermined period after the startup of an internal combustion engine. This control apparatus takes into account that part of injected fuel adheres to an intake system or the like and hence is not burned.

On the other hand, a feedback process for controlling a detection value of an air-fuel ratio sensor to a target air-fuel ratio in a feedback manner is well-known.

SUMMARY

In the case where the amount of injection is increased as described above, it is difficult to set an amount of increase that is precisely equal to an amount of fuel that adheres to the intake system and hence is not burned, through open-loop control. Therefore, a surplus amount of increase is usually corrected in a decreasing manner through the feedback process. It should be noted, however, that the amount of combustion energy may become excessively large in the case where the amount of increase is excessively large when the feedback process is stopped.

Means for solving the foregoing problem and the operation and effect thereof will be described hereinafter.

1. A control apparatus for an internal combustion engine is applied to an internal combustion engine having a plurality of cylinders. The control apparatus performs a base injection amount calculation process for calculating a base value of an injection amount of fuel injection valves that supply fuel to the cylinders respectively, a correction process for correcting the injection amount from the base value, and an injection valve operation process for operating the fuel injection valves in accordance with an output of the correction process. The correction process includes a low-temperature increase process, a feedback process, and a stop decrease process. The low-temperature increase process is a process of correcting the injection amount in an increasing manner when an increase index value that is an index value of a temperature of the internal combustion engine is smaller than a threshold. The feedback process is a process of correcting the injection amount to control an air-fuel ratio of an air-fuel mixture in the cylinders of the internal combustion engine to a target air-fuel ratio in a feedback manner. The stop decrease process is a process of correcting the injection amount in a decreasing manner when a decrease index value that is an index value of the temperature of the internal combustion engine is smaller than a predetermined value and the feedback process is stopped.

According to the foregoing configuration, when the internal combustion engine is at low temperature, the injection amount is corrected in an increasing manner through the low-temperature increase process. The fuel subjected to the increase correction does not always entirely adhere to the intake system or wall surfaces of the cylinders and fail to be included in the air-fuel mixture without being burned. Therefore, when the feedback process is stopped, the amount of fuel in the air-fuel mixture may become excessively large due to the low-temperature increase process. Thus, in the foregoing configuration, the amount of fuel to be burned can be restrained from becoming excessively large, by decreasing the injection amount through the stop decrease process when the feedback process is stopped and the decrease index value is smaller than the predetermined value.

2. In the control apparatus for the internal combustion engine described above in 1, the stop decrease process may be a process of correcting the injection amount in a decreasing manner in accordance with a value of a correction coefficient of the injection amount corrected through the feedback process before stoppage of the feedback process.

When the injection amount increased through the low-temperature increase process is excessively large as the amount of compensation for the amount of fuel that is not included in the air-fuel mixture through adhesion, the correction coefficient of the feedback process is determined in accordance with the amount of excess. In the foregoing configuration, therefore, an appropriate amount of fuel corresponding to the amount of excess of fuel in the air-fuel mixture can be decreased by correcting the injection amount in a decreasing manner in accordance with the value of the correction coefficient before stoppage of the feedback process, after stoppage of the feedback process.

3. The control apparatus for the internal combustion engine described above in 2 may further perform an acquisition process for acquiring a value obtained by reducing fluctuations in the correction coefficient before stoppage of the feedback process, and the stop decrease process may be a process of correcting the injection amount in a decreasing manner in accordance with the value acquired through the acquisition process.

In the foregoing configuration, the injection amount is corrected in a decreasing manner in accordance with the value obtained by reducing fluctuations in the correction coefficient. Therefore, the influence of noise before stoppage of the feedback process on the stop decrease process can be suppressed.

4. In the control apparatus for the internal combustion engine described above in any one of 1 to 3, the stop decrease process may include a process of using an integrated air amount from the startup of the internal combustion engine as the decrease index value. The integrated air amount of the internal combustion engine is correlated with the cumulative amount of combustion energy of the internal combustion engine. The temperature of the internal combustion engine rises as the cumulative value of the amount of combustion energy increases. Therefore, according to the foregoing configuration, it becomes possible to accurately determine whether to perform the stop decrease process or not, by adopting the integrated air amount as the decrease index value.

5. In the control apparatus for the internal combustion engine described above in 4, the low-temperature increase process may be a process of making the amount corrected in an increasing manner larger when the increase index value is small than when the increase index value is large, and the predetermined value may be set as a value that is larger when a setting index value that is an index value of the temperature of the internal combustion engine at the time of startup is small than when the setting index value at the time of startup is large.

The amount of injected fuel that fails to form the air-fuel mixture by adhering to the intake system or the wall surfaces of the cylinders is larger when the temperature of the internal combustion engine is low than when the temperature of the internal combustion engine is high. In the foregoing configuration, therefore, the increase correction amount can be appropriately determined in accordance with the temperature of the internal combustion engine, by making the amount of increase correction larger when the temperature of the internal combustion engine is low than when the temperature of the internal combustion engine is high. Besides, the cumulative value of combustion energy that is needed until the amount of fuel in the air-fuel mixture fails to become excessively large as a result of the low-temperature increase process is larger when the temperature in starting up the internal combustion engine is low than when the temperature in starting up the internal combustion engine is high. Thus, in the foregoing configuration, the integrated air amount to the timing when the decrease index value becomes equal to or larger than the predetermined value can be made larger when the temperature in starting up the internal combustion engine is low than when the temperature in starting up the internal combustion engine is high, by setting the predetermined value larger when the temperature at the time of startup is low than when the temperature at the time of startup is high.

6. The control apparatus for the internal combustion engine described above in any one of 1 to 5 may further perform a stop process. The stop process may be a process of stopping fuel injection by the fuel injection valve of one of the cylinders or the fuel injection valves of some of the cylinders and continuing fuel injection in the other cylinders or the other cylinder, the feedback process may be stopped when the stop process is performed, and the stop decrease process may be performed when the decrease index value is smaller than the predetermined value during the performance of the stop process.

When the stop process is performed, it is difficult to perform the feedback process of the air-fuel ratio. In the foregoing configuration, therefore, the feedback process is stopped when the stop process is performed.

7. In the control apparatus for the internal combustion engine described above in 6, the internal combustion engine may be equipped with a catalyst capable of occluding oxygen in an exhaust passage, a rich combustion process for making the air-fuel ratio of the air-fuel mixture in the other cylinders or the other cylinder richer than a theoretical air-fuel ratio may be performed when the stop process is performed, and the stop process and the rich combustion process may constitute a temperature raising process for raising a temperature of an exhaust system of the internal combustion engine.

In the foregoing configuration, the temperature of the exhaust system can be raised through an oxidation reaction of oxygen that has flowed into the catalyst from one or some of the cylinders and unburnt fuel that has flowed from the other cylinders or the other cylinder into the catalyst. It should be noted, however, that the temperature of the exhaust system may become excessively high when part of the fuel that has been increased in amount through the low-temperature increase process flows into the catalyst inadvertently. Therefore, it is especially effective to perform the stop decrease process.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein.

DETAILED DESCRIPTION OF EMBODIMENTS

One of the embodiments will be described hereinafter with reference to the drawings.

Figure 1:
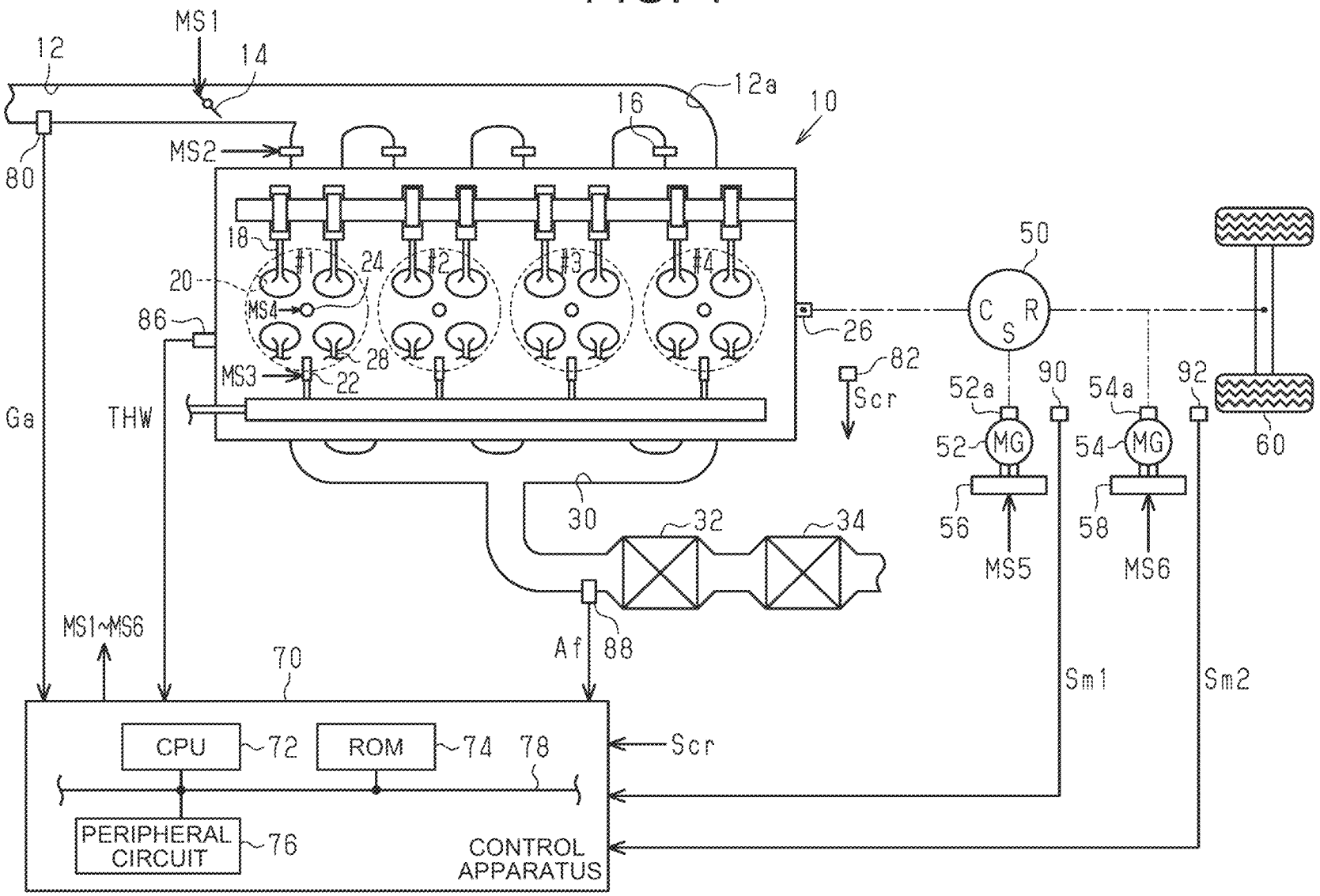
FIG. 1 is a view showing the configuration of a hybrid vehicle according to one of the embodiments.

As shown in FIG. 1, an internal combustion engine 10 is equipped with four cylinders #1 to #4. A throttle valve 14 is provided in an intake passage 12 of the internal combustion engine 10. An intake port 12*a* as a downstream region of the intake passage 12 is provided with port injection valves 16 that inject fuel into the intake port 12*a*. The air sucked into the intake passage 12 and the fuel injected from the port injection valves 16 flow into combustion chambers 20 as intake valves 18 are opened respectively. Fuel is injected into the combustion chambers 20 from in-cylinder injection valves 22 respectively. Besides, a mixture of air and fuel in the combustion chambers 20 is subjected to combustion as ignition plugs 24 discharge sparks respectively. The combustion energy generated at this time is converted into rotational energy of a crankshaft 26.

The air-fuel mixture subjected to combustion in the combustion chambers 20 is discharged to an exhaust passage 30 as exhaust gas as exhaust valves 28 are opened respectively. In the exhaust passage 30, a three-way catalyst 32 capable of occluding oxygen and a gasoline particulate filter (GPF) 34 are provided. Incidentally, in the present embodiment, the GPF 34 is assumed to be a filter for collecting particulate matter (PM) on which a three-way catalyst capable of occluding oxygen is carried.

The crankshaft 26 is mechanically coupled to a carrier C of a planetary gear mechanism 50 constituting a motive power splitting device. A rotary shaft 52*a* of a first motor-generator 52 is mechanically coupled to a sun gear S of the planetary gear mechanism 50. Besides, a rotary shaft 54*a* of a second motor-generator 54 and driving wheels 60 are mechanically coupled to a ring gear R of the planetary gear mechanism 50. An AC voltage is applied to a terminal of the first motor-generator 52 by an inverter 56. Besides, an AC voltage is applied to a terminal of the second motor-generator 54 by an inverter 58.

A control apparatus 70 is designed to control the internal combustion engine 10, and operates operational portions of the internal combustion engine 10 such as the throttle valve 14, the port injection valves 16, the in-cylinder injection valves 22, and the ignition plugs 24 to control a torque, an exhaust gas component ratio and the like as controlled variables of the internal combustion engine 10. Besides, the control apparatus 70 is designed to control the first motor-generator 52, and operates the inverter 56 to control a rotational speed as a controlled variable of the first motor-generator 52. Besides, the control apparatus 70 is designed to control the second motor-generator 54, and operates the inverter 58 to control a torque as a controlled variable of the second motor-generator 54. In FIG. 1, operation signals MS1 to MS6 for the throttle valve 14, the port injection valves 16, the in-cylinder injection valves 22, the ignition plugs 24, and the inverters 56 and 58 respectively are depicted. In order to control the controlled variables of the internal combustion engine 10, the control apparatus 70 refers to an intake air amount Ga detected by an airflow meter 80, an output signal Scr of a crank angle sensor 82, a coolant temperature THW detected by a coolant temperature sensor 86, and an air-fuel ratio Af detected by an air-fuel ratio sensor 88 provided upstream of the three-way catalyst 32. Besides, in order to control the controlled variable of the first motor-generator 52, the control apparatus 70 refers to an output signal Sm1 of a first rotational angle sensor 90 that detects a rotational angle of the first motor-generator 52. Besides, in order to control the controlled variable of the second motor-generator 54, the control apparatus 70 refers to an output signal Sm2 of a second rotational angle sensor 92 that detects a rotational angle of the second motor-generator 54.

The control apparatus 70 is equipped with a CPU 72, a ROM 74, and a peripheral circuit 76, which can communicate with one another through a communication line 78. It should be noted herein that the peripheral circuit 76 includes a circuit that generates a clock signal for prescribing the behavior inside the peripheral circuit 76, an electric power supply circuit, a reset circuit, and the like. The control apparatus 70 controls the controlled variables through the execution of a program stored in the ROM 74 by the CPU 72.

The CPU 72 performs a basic fuel injection process, a process of regenerating the GPF 34, and an injection amount correction process in the case where the temperature of the internal combustion engine 10 is low at the time of the regeneration process, according to the program stored in the ROM 74. These processes will be described hereinafter sequentially.

(Basic Fuel Injection Process)

Figure 2:
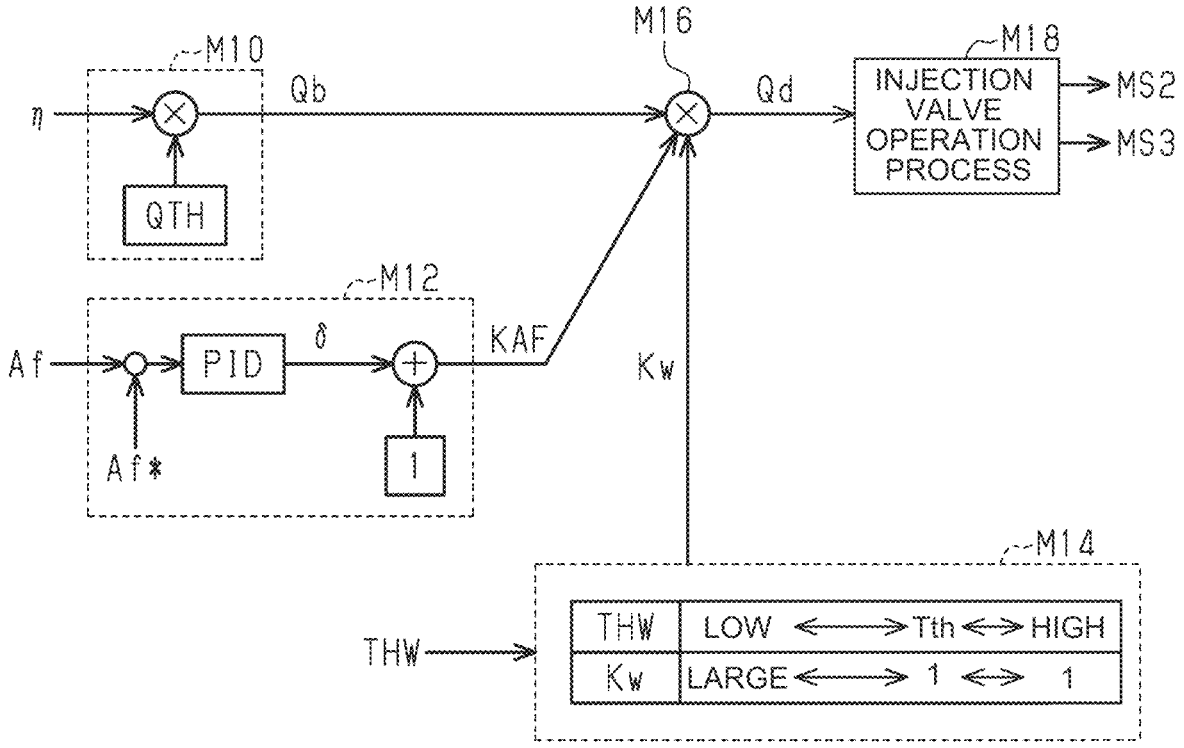
FIG. 2 is a block diagram exemplifying a process that is performed by a control apparatus according to the embodiment.

FIG. 2 shows a process that is performed by the control apparatus 70. The process shown in FIG. 2 is realized through the execution of the program stored in the ROM 74 by the CPU 72.

A base injection amount calculation process M10 is a process of calculating a base injection amount Qb that is a base value of a fuel amount for making the air-fuel ratio of the air-fuel mixture in the combustion chambers 20 equal to a target air-fuel ratio, based on a filling efficiency η. More specifically, the base injection amount calculation process M10 may be a process of calculating the base injection amount Qb by multiplying a fuel amount QTH per percent of the filling efficiency η for making the air-fuel ratio equal to the target air-fuel ratio by the filling efficiency η in the case where, for example, the filling efficiency η is expressed as percent. The base injection amount Qb is a fuel amount calculated to control the air-fuel ratio to the target air-fuel ratio, based on an amount of air with which the combustion chambers 20 are filled. Incidentally, in the present embodiment, the target air-fuel ratio is a theoretical air-fuel ratio. It should be noted herein that the filling efficiency η is calculated based on the intake air amount Ga and a rotational speed NE by the CPU 72. Besides, the rotational speed NE is calculated based on the output signal Scr by the CPU 72.

A correction coefficient calculation process M12 is a process of calculating and outputting a feedback correction coefficient KAF. The feedback correction coefficient KAF is a value obtained by adding "1" to a correction ratio δ of the base injection amount Qb as a feedback operation amount that is an operation amount for controlling the air-fuel ratio Af to a target value Af* in a feedback manner. More specifically, the correction coefficient calculation process M12 adopts the sum of output values of a proportional element and a differential element to which a difference between the air-fuel ratio Af and the target value Af* is input and an output value of an integral element from which an integral value that is a value corresponding to the difference is output, as the correction ratio δ.

A low-temperature increase process M14 is a process of calculating a low-temperature increase coefficient Kw of the base injection amount Qb as a value larger than "1" when the coolant temperature THW is lower than a prescribed temperature Tth. It should be noted herein that the prescribed temperature Tth may be, for example, "40° C."In the low-temperature increase process M14, the low-temperature increase coefficient Kw is set to a value that is larger when the coolant temperature THW is low than when the coolant temperature THW is high, in the case where the coolant temperature THW is lower than the prescribed temperature Tth. The low-temperature increase coefficient Kw is set in consideration of the fuel having such a property that a large amount thereof adheres to an intake system and wall surfaces of the cylinders without contributing to combustion as the air-fuel mixture in a situation where the internal combustion engine 10 has not been sufficiently warmed up, for example, heavy fuel. That is, the low-temperature increase coefficient Kw is set to an amount that restrains the air-fuel ratio of the air-fuel mixture from becoming excessively lean and hence suppresses the occurrence of misfire even in the case where the fuel having such a property is used. Accordingly, in the case where fuel that is more likely to gasify than the fuel having such a property is used, the air-fuel ratio of the air-fuel mixture is likely to become richer than the theoretical air-fuel ratio due to the fuel subjected to correction with the low-temperature increase coefficient Kw.

Incidentally, a process of subjecting the low-temperature increase coefficient Kw to map computation by the CPU 72 with map data having the coolant temperature THW as an input variable and the low-temperature increase coefficient Kw as an output variable stored in the ROM 74 in advance may be performed, but an applicable embodiment is not limited thereto. For example, the low-temperature increase coefficient Kw may be calculated as a product or sum of some variables. Besides, for example, a period in which the degree of warmup of the internal combustion engine 10 is low may be divided into a plurality of periods, and the low-temperature increase coefficient Kw may be calculated for each of the periods through the use of separate map data. In concrete terms, the period in which the degree of warmup of the internal combustion engine 10 is low may be divided into a period to a timing when the rotational speed NE becomes equal to or higher than a predetermined speed as a result of the startup of the internal combustion engine 10 and the other periods. In this case, as for the other periods, some variables regarding correction may be calculated from mutually independent standpoints to obtain the ultimate low-temperature increase coefficient Kw. In any of these cases, the low-temperature increase coefficient Kw may be calculated as a value that increases as the coolant temperature THW lowers.

Incidentally, the map data are set data of discrete values of the input variable and values of the output variable corresponding to the values of the input variable respectively. Besides, map computation may be, for example, a process of adopting the value of the output variable in the corresponding map data as a computation result when the value of the input variable coincides with any one of the values of the input variable in the map data, and adopting a value obtained through interpolation of a pair of values of the output variable included in the map data as a computation result when the value of the input variable does not coincide with any one of the values of the input variable in the map data.

A required injection amount calculation process M16 is a process of calculating a fuel amount (a required injection amount Qd) required in one combustion cycle by multiplying the base injection amount Qb by the feedback correction coefficient KAF and the low-temperature increase coefficient Kw.

An injection valve operation process M18 is a process of outputting an operation signal MS2 to the port injection valves 16 to operate the port injection valves 16, and outputting an operation signal MS3 to the in-cylinder injection valves 22 to operate the in-cylinder injection valves 22. In particular, the injection valve operation process M18 is a process of setting an amount of fuel injected from the port injection valves 16 and the in-cylinder injection valves 22 in one combustion cycle, as an amount corresponding to the required injection amount Qd.

(Regeneration Process for GPF 34)

Figure 3:
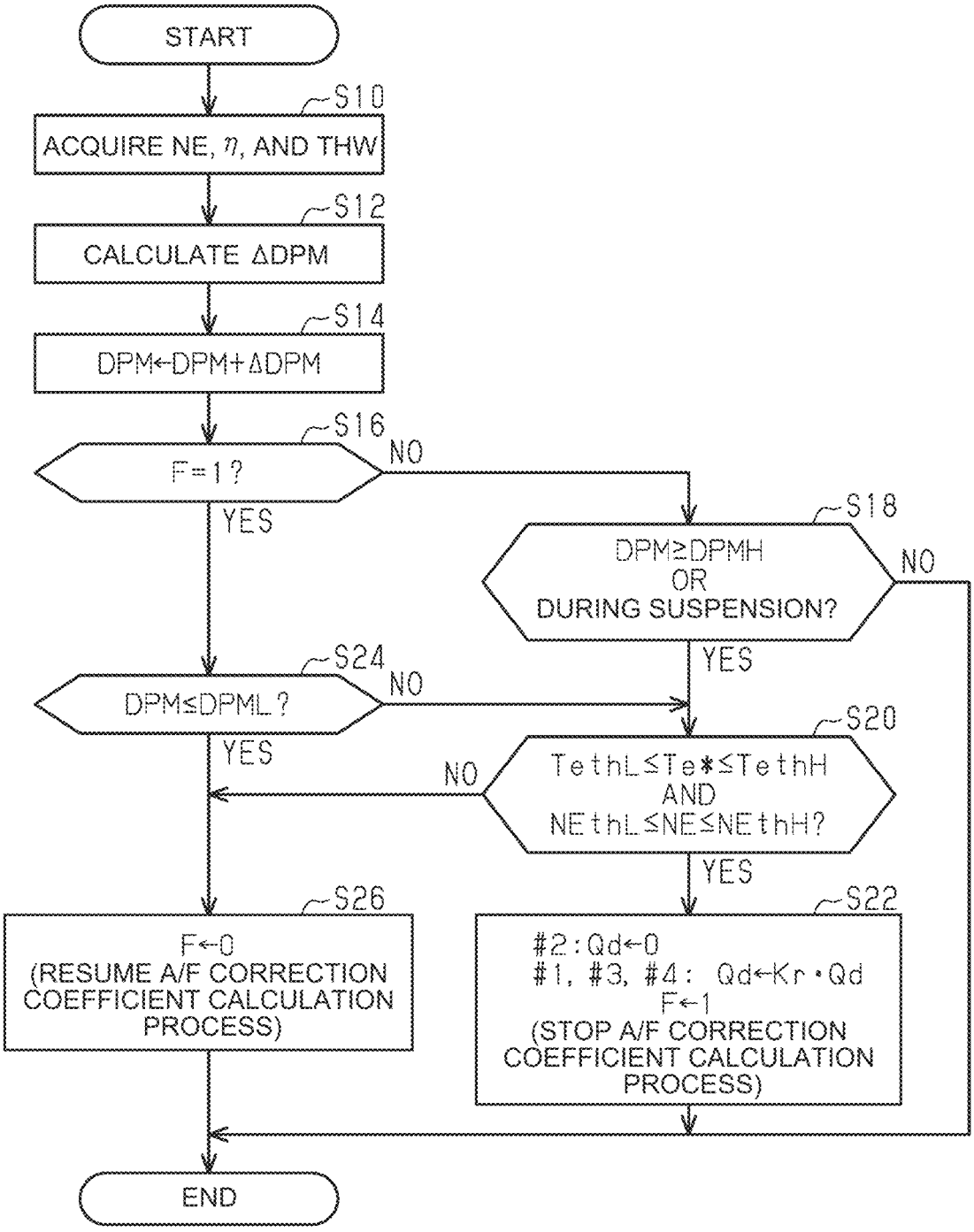
FIG. 3 is a flowchart showing a procedure of the process that is performed by the control apparatus according to the embodiment.

FIG. 3 shows the procedure of the regeneration process. The process shown in FIG. 3 is realized through the repeated execution of the program stored in the ROM 74 on, for example, a predetermined cycle by the CPU 72. Incidentally, a step number in each of processing steps will be denoted hereinafter by a numeral preceded by "S".

In a series of the processing steps shown in FIG. 3, the CPU 72 first acquires the rotational speed NE, the filling efficiency and the coolant temperature THW (S10). The CPU 72 then calculates an update amount ΔDPM of a deposition amount DPM based on the rotational speed NE, the filling efficiency η, and the coolant temperature THW (S12). It should be noted herein that the deposition amount DPM is an amount of PM collected by the GPF 34. More specifically, the CPU 72 calculates an amount of PM in exhaust gas discharged into the exhaust passage 30, based on the rotational speed NE, the filling efficiency η, and the coolant temperature THW. Besides, the CPU 72 calculates a temperature of the GPF 34 based on the rotational speed NE and the filling efficiency η. The CPU 72 then calculates the update amount ΔDPM based on the amount of PM in exhaust gas and the temperature of the GPF 34. Incidentally, when the processing of step S22 that will be described later is performed, the temperature of the GPF 34 and the update amount ΔDPM may be calculated based on a temperature raising increase coefficient Kr.

Subsequently, the CPU 72 updates the deposition amount DPM in accordance with the update amount ΔDPM (S14). The CPU 72 then determines whether or not a performance flag F is "1" (S16). When being "1", the performance flag F indicates that the temperature raising process for removing the PM in the GPF 34 through combustion is performed. When being "0", the performance flag F indicates that the temperature raising process is not performed. If it is determined that the performance flag F is "0" (NO in S16), the CPU 72 determines whether or not the logical sum of that the deposition amount DPM is equal to or larger than a regeneration performance value DPMH and that the processing of S22 that will be described later has been interrupted is true (S18). The regeneration performance value DPMH is set to a value at which the removal of PM is desired because the amount of PM collected by the GPF 34 is large.

If it is determined that the logical sum is true (YES in S18), the CPU 72 determines whether or not a condition that the logical product of conditions (i) and (ii) shown below is true, namely, a condition for performing the temperature raising process is fulfilled (S20).

The condition (i) is that an engine torque command value Te* that is a command value of the torque for the internal combustion engine 10 is equal to or larger than a lower-limit torque TethL and equal to or smaller than an upper-limit torque TethH. The condition (ii) is that the rotational speed NE of the internal combustion engine 10 is equal to or higher than a lower-limit speed NEthL and equal to or lower than an upper-limit speed NEthH.

Incidentally, in an operating state where the engine torque command value Te* is larger than the upper-limit torque TethH and the rotational speed NE is higher than the upper-limit speed NEthH, the temperature of exhaust gas is high in the first place, and the deposition amount DPM is unlikely to increase even when the processing of S22 that will be described later is not performed.

If it is determined that the logical product is true (YES in S20), the CPU 72 performs the temperature raising process, and assigns "1" to the performance flag F (S22). As the temperature raising process according to the present embodiment, the CPU 72 stops injection of fuel from the port injection valve 16 and the in-cylinder injection valve 22 in the cylinder #2, and makes the air-fuel ratio of the air-fuel mixture in the combustion chambers 20 of the cylinders #1, #3, and #4 richer than the theoretical air-fuel ratio. This process is, first of all, a process for raising the temperature of the three-way catalyst 32. That is, unburnt fuel is oxidized in the three-way catalyst 32 and the temperature of the three-way catalyst 32 is raised, by discharging oxygen and unburnt fuel to the exhaust passage 30. Secondly, this process is a process for raising the temperature of the GPF 34, supplying oxygen to the high-temperature GPF 34, and removing the PM collected by the GPF 34 through oxidation. That is, when the temperature of the three-way catalyst 32 becomes high, the temperature of the GPF 34 rises due to the flow of high-temperature exhaust gas into the GPF 34. The PM collected by the GPF 34 is then removed through oxidation due to the flow of oxygen into the high-temperature GPF 34.

More specifically, the CPU 72 assigns "0" to the required injection amount Qd for the port injection valve 16 and the in-cylinder injection valve 22 in the cylinder #2. On the other hand, the CPU 72 assigns a value obtained by multiplying the required injection amount Qd by the temperature raising increase coefficient Kr to the required injection amount Qd of the cylinders #1, #3, and #4.

The CPU 72 sets the temperature raising increase coefficient Kr such that the amount of unburnt fuel in the exhaust gas discharged to the exhaust passage 30 from the cylinders #1, #3, and #4 becomes equal to or smaller than such an amount as to ensure reaction with the oxygen discharged from the cylinder #2 in just proportion. More specifically, the CPU 72 sets the air-fuel ratio of the air-fuel mixture in the cylinders #1, #3, and #4 to a value that is as close as possible to the amount corresponding to reaction in just proportion, with a view to raising the temperature of the three-way catalyst 32 at an early stage, at the beginning of the regeneration process for the GPF 34.

Incidentally, the CPU 72 stops the correction coefficient calculation process M12 in performing the temperature raising process. On the other hand, if it is determined that the performance flag F is "1" (YES in S16), the CPU 72 determines whether or not the deposition amount DPM is equal to or smaller than a stop threshold DPML (S24). The stop threshold DPML is set to a value at which the regeneration process may be stopped because the amount of PM collected by the GPF 34 is sufficiently small. If it is determined that the deposition amount DPM is larger than the stop threshold DPML (NO in S24), the CPU 72 shifts to the processing of S20.

On the other hand, if the deposition amount DPM is equal to or smaller than the stop threshold DPML (YES in S24) or if the result of the determination in the processing of S20 is negative, the CPU 72 stops or interrupts the processing of S22, and assigns "0" to the performance flag F (S26). It should be noted herein that the processing of S22 is regarded as having been completed and stopped when the result of the determination in the processing of S24 is positive, and that the processing of S22 is interrupted before being completed when the result of the determination in the processing of S20 is negative. Besides, the CPU 72 resumes the correction coefficient calculation process M12.

Incidentally, when the processing of S22 or S26 is completed or if the result of the determination in the processing of S18 is negative, the CPU 72 temporarily ends the series of the processing steps shown in FIG. 2.

(Injection Amount Correction Process in Case where Temperature of Internal Combustion Engine 10 is Low)

As described above, the correction coefficient calculation process M12 is stopped at the time of the regeneration process in the present embodiment. In the present embodiment, however, when the temperature of the internal combustion engine 10 is low, a fuel decrease correction process is performed, and the correction coefficient at this time is determined in accordance with the feedback correction coefficient KAF.

Figure 4:
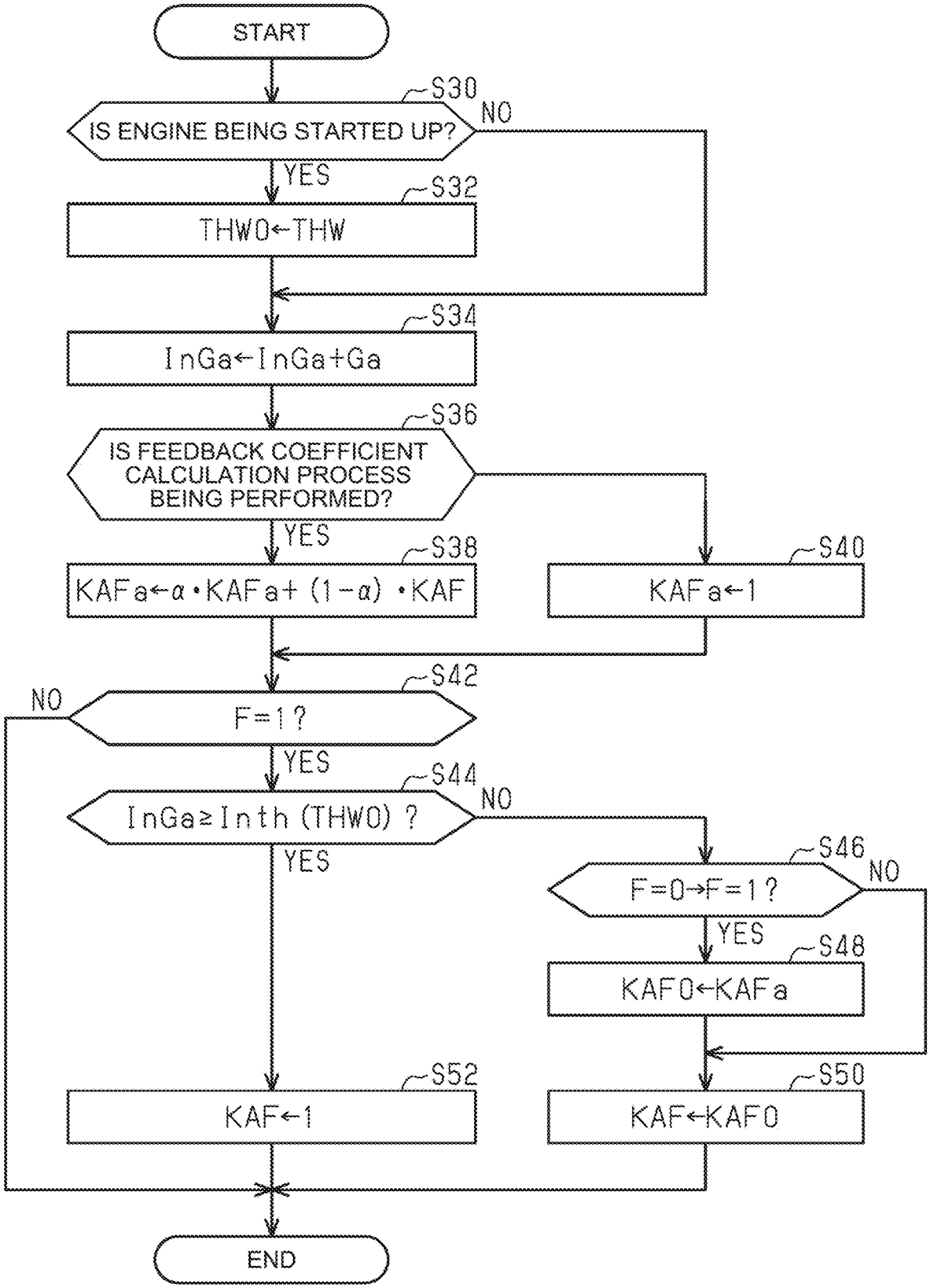
FIG. 4 is a flowchart showing a procedure of a process regarding decrease of an injection amount according to the embodiment.

FIG. 4 shows the procedure of the decrease correction process. The process shown in FIG. 4 is realized through the repeated execution of a program stored in the ROM 74 on, for example, a predetermined cycle by the CPU 72. In a series of processing steps shown in FIG. 4, the CPU 72 first determines whether or not the internal combustion engine 10 is being started up (S30). If it is determined that the internal combustion engine 10 is being started up (YES in S30), the CPU 72 then assigns the coolant temperature THW detected by the coolant temperature sensor 86 at that time to a startup coolant temperature THW0 (S32). When the processing of S32 is completed or if the result of the determination in the processing of S30 is negative, the CPU 72 assigns a value obtained by adding the intake air amount Ga to an integrated air amount InGa that is an integrated value of the intake air amount, to the integrated air amount InGa (S34).

Subsequently, the CPU 72 determines whether or not the correction coefficient calculation process M12 is being performed (S36). The correction coefficient calculation process M12 is not performed not only when the performance flag F is "1" but also when the air-fuel ratio sensor 88 is not activated or when a predetermined diagnosis process is performed. If it is determined that the correction coefficient calculation process M12 is being performed (YES in S36), the CPU 72 calculates an average correction coefficient KAFa through an exponential moving average process for the feedback correction coefficient KAF (S38). That is, the CPU 72 assigns the sum of a value obtained by multiplying the average correction coefficient KAFa by a coefficient $\alpha$ and a value obtained by multiplying the feedback correction coefficient KAF by "1-$\alpha$" to the average correction coefficient KAFa. Incidentally, the coefficient c is a value larger than zero and smaller than "1".

On the other hand, if the correction coefficient calculation process M12 is not being performed (NO in S36), the CPU 72 assigns "1" to the average correction coefficient KAFa (S40). When the processing of S38 or S40 is completed, the CPU 72 determines whether or not the performance flag F is "1" (S42). If it is determined that the performance flag F is "1" (YES in S42), the CPU 72 determines whether or not the integrated air amount InGa is equal to or larger than a predetermined value Inth (S44). The CPU 72 sets the predetermined value Inth to a value that is larger when the startup coolant temperature THW0 is low than when the startup coolant temperature THW0 is high. This process may be realized by subjecting the predetermined value Inth to map computation by the CPU 72, with map data having the startup coolant temperature THW0 as an input variable and the predetermined value Inth as an output variable stored in the ROM 74 in advance.

If it is determined that the integrated air amount InGa is smaller than the predetermined value Inth (NO in S44), the CPU 72 shifts to the processing of S46. It should be noted herein that the integrated air amount InGa is smaller than the predetermined value Inth when the stoppage of the correction coefficient calculation process M12 may lead to low controllability of the air-fuel ratio due to the influence of the correction of the injection amount by the low-temperature increase coefficient Kw. In the processing of S46, the CPU 72 determines whether or not the performance flag F has been changed over from "0" to "1". If it is determined that the performance flag F has been changed over from "0" to "1" (YES in S46), the CPU 72 then assigns the average correction coefficient KAFa to a decrease coefficient value KAF0 (S48). When the processing of S48 is completed or if the result of the determination in the processing of S46 is negative, the CPU 72 assigns the decrease coefficient value KAF0 to the feedback correction coefficient KAF (S50).

On the other hand, if it is determined that the integrated air amount InGa is equal to or larger than the predetermined value Inth (YES in S44), the CPU 72 assigns "1" to the feedback correction coefficient KAF (S52). Incidentally, when the processing of S50 or S52 is completed or if the result of the determination in the processing of S42 is negative, the CPU 72 temporarily ends the series of the processing steps shown in FIG. 4.

The operation and effect of the present embodiment will now be described.

Figure 5:
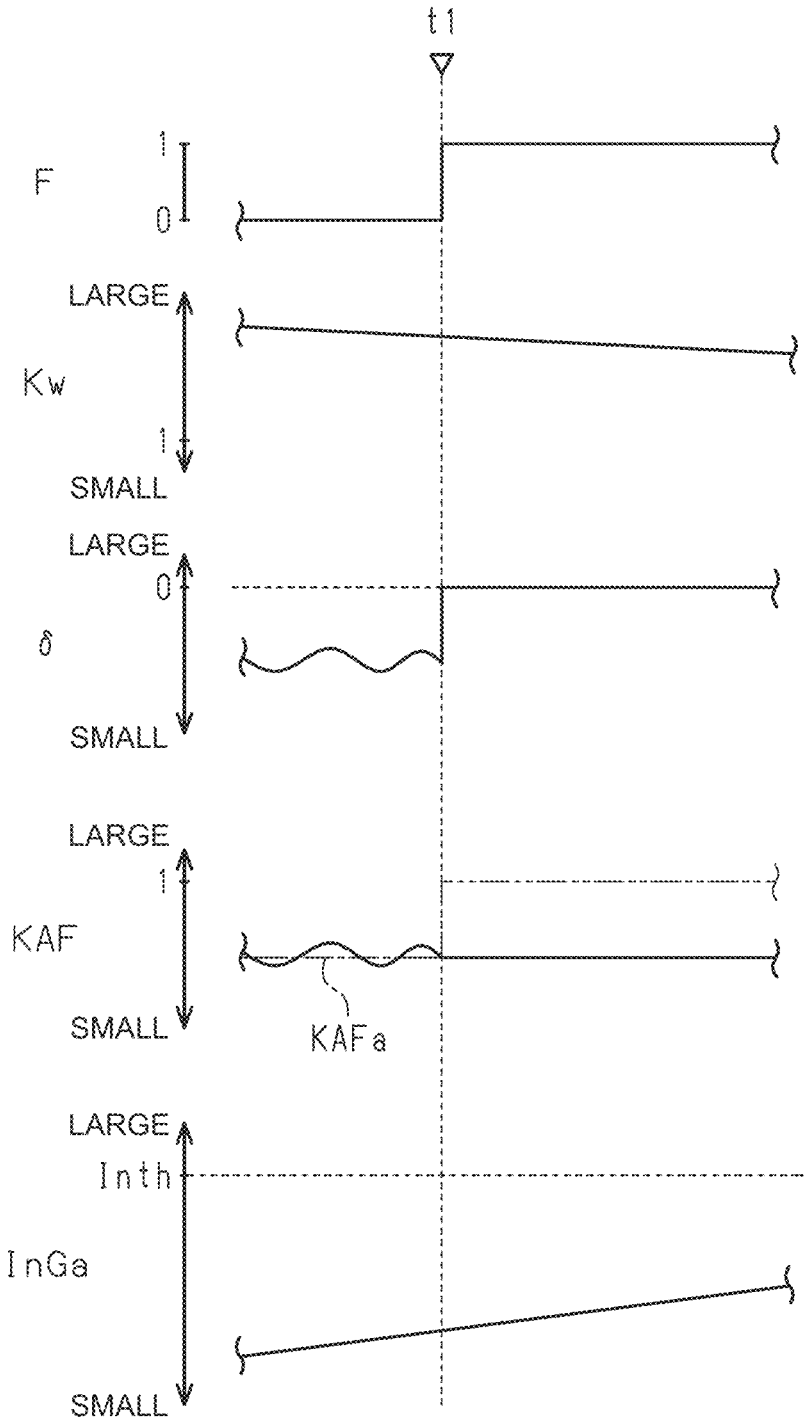
FIG. 5 is a time chart showing the process regarding decrease of the injection amount of the embodiment.

FIG. 5 exemplifies changes in the feedback correction coefficient KAF. In the example shown in FIG. 5, a fuel that is more likely to gasify than the least gasifiable fuel that is assumed through the setting of the low-temperature increase coefficient Kw is used in particular.

As shown in FIG. 5, when the performance flag F is changed over to "1" at a timing t1, the correction coefficient calculation process M12 is stopped, so the correction ratio $\delta$ is set to zero. Accordingly, when the process shown in FIG. 4 is not performed, the feedback correction coefficient KAF is set to "1" as indicated by an alternate long and two short dashes line in FIG. 5.

In the example shown in FIG. 5, before the timing t1, the correction ratio is negative, and the feedback correction coefficient KAF is smaller than "1". This means that the injection amount is excessively increased by the low-temperature increase coefficient Kw, and the required injection amount Qd is excessively large for the amount of fuel that is needed to make the air-fuel ratio of the air-fuel mixture equal to the target value. This excessive fuel is compensated for by the feedback correction coefficient KAF, and hence the air-fuel ratio of the air-fuel mixture can be controlled to the target value.

It should be noted, however, that even when the required injection amount Qd is excessively large for an intended amount of fuel due to the low-temperature increase coefficient Kw, this cannot be compensated for because the correction coefficient calculation process M12 is stopped as soon as the performance flag F becomes "1". Therefore, the actual air-fuel ratio becomes richer than an intended rich air-fuel ratio in the cylinders #1, #3, and #4, and an unimaginably large amount of unburnt fuel may flow into the three-way catalyst 32. In this case, the controllability of the temperature of the three-way catalyst 32 deteriorates.

In contrast, since the integrated air amount InGa is smaller than the predetermined value Inth, the CPU 72 fixes the feedback correction coefficient KAF to the average correction coefficient KAFa immediately before the changeover of the performance flag F to "1". Thus, the degree of richness of the actual air-fuel ratio can be favorably restrained from rising with respect to the intended air-fuel ratio due to the low-temperature increase coefficient Kw. Therefore, the temperature of the three-way catalyst 32 can be restrained from rising unimaginably.

Operations and effects mentioned below are further obtained from the present embodiment described above.

(1) The average correction coefficient KAFa is adopted as the decrease coefficient value KAF0. Thus, the decrease coefficient value KAF0 of noise can be restrained from being influenced before the stoppage of the feedback process.

(2) When the integrated air amount InGa is smaller than the predetermined value Inth, the injection amount is corrected in accordance with the decrease coefficient value KAF0. The integrated air amount InGa is correlated with a cumulative amount of combustion energy of the internal combustion engine 10. Moreover, the temperature of the internal combustion engine 10 rises as the cumulative value of the amount of combustion energy increases. Therefore, through the use of the integrated air amount InGa, it is possible to accurately determine whether or not the situation where the controllability of the air-fuel ratio of the air-fuel mixture deteriorates due to the influence of the low-temperature increase coefficient Kw has ceased to exist.

In particular, through the use of the integrated air amount InGa, it is possible to easily determine whether or not the foregoing situation has ceased to exist, even when the low-temperature increase coefficient Kw is actually constituted of some coefficients and is calculated according to a complicated logic.

(3) The predetermined value Inth is set to a value that is larger when the coolant temperature THW in starting up the internal combustion engine 10 is low than when the coolant temperature THW in starting up the internal combustion engine 10 is high. The cumulative value of combustion energy that is needed until the state of the internal combustion engine 10 gets out of the foregoing situation is larger when the temperature in starting up the internal combustion engine 10 is low than when the temperature in starting up the internal combustion engine 10 is high. Therefore, by setting the predetermined value Inth in accordance with the startup coolant temperature THW0, it becomes possible to more accurately determine whether or not the foregoing situation has ceased to exist, than in the case where the predetermined value Inth is a fixed value.

(Corresponding Relationship)

A corresponding relationship between the items in the foregoing embodiment and the items mentioned in the foregoing section of "Means for Solving the Problem" is as follows. The corresponding relationship will be mentioned hereinafter for each of the numbers of the means for solution described in the section of "Means for Solving the Problem". [1 ]The base injection amount calculation process corresponds to the base injection amount calculation process M10. The correction process corresponds to the correction coefficient calculation process M12, the low-temperature increase process M14, and the required injection amount calculation process M16. The stop decrease process corresponds to the processing of S50. [2] The correction coefficient for the injection amount according to the feedback process before stoppage corresponds to the feedback correction coefficient KAF for a plurality of times that is used to calculate "KAF0". [3] The acquisition process corresponds to the processing of S48. [4] The means for solution 4 corresponds to the processing of S44. [5] The means for solution 5 corresponds to the setting of the predetermined value Inth in accordance with the startup coolant temperature THW0. [6] The stop process corresponds to the processing of S22. [7] The temperature raising process corresponds to the processing of S22. The rich combustion process corresponds to the determination of the required injection amount Qd for the cylinders #1, #3, and #4 by the temperature raising increase coefficient Kr in the processing of S22.

(Other Embodiments)

Incidentally, the present embodiment can be realized after being modified as follows. The present embodiment and the following modification examples can be carried out in combination with one another within such a range as not to cause any technical contradiction.

"As for Low-Temperature Increase Process"

The low-temperature increase process may not necessarily be a process of giving the low-temperature increase coefficient Kw for the base injection amount Qb. For example, the low-temperature increase process may be a process of giving an increase amount for the base injection amount Qb. Alternatively, for example, the low-temperature increase process may be a process of giving an increase amount for "KAF·Qb".

The increase index value that is an index value of the temperature of the internal combustion engine 10 that is referred to in determining whether to perform the low-temperature increase process or not may not necessarily be the coolant temperature THW. For example, this increase index value may be a temperature of lubricating oil of the internal combustion engine 10. Alternatively, a plurality of variables such as two variables, namely, the coolant temperature THW and the temperature of lubricating oil may be used as the increase index value.

"As for Acquisition Process"

In the foregoing embodiment, the average correction coefficient KAFa is assigned to the decrease coefficient value KAF0, but an applicable embodiment is not limited thereto. For example, the output value of the integral element of the correction coefficient calculation process M12 before the changeover of the value of the performance flag F to "1" may be assigned to the decrease coefficient value KAF0.

"As for Stop Decrease Process"

In the foregoing embodiment, when the integrated air amount InGa reaches the predetermined value Inth in the course of the temperature raising process, the feedback correction coefficient KAF is set to "1". In other words, the stop decrease correction process is stopped. Instead, however, if the stop decrease process is performed when the integrated air amount InGa is smaller than the predetermined value Inth in starting the temperature raising process, the stop decrease process may be continued while the temperature raising process is performed.

In the foregoing embodiment, the decrease amount is determined through the direct use of the feedback correction coefficient KAF for the air-fuel ratio, but an applicable embodiment is not limited thereto. For example, when the regeneration process is performed at low temperature, the injection amount may be decreased using a dedicated decrease coefficient that is smaller than "1", while the feedback correction coefficient KAF is held equal to "1".

In the foregoing embodiment, when the regeneration process is performed at low temperature, the feedback correction coefficient KAF is fixed to the decrease coefficient value KAF0, but an applicable embodiment is not limited thereto. For example, the feedback correction coefficient KAF for the decrease coefficient value KAF0 may be gradually increased toward "1" with the passage of time.

In the foregoing embodiment, the decrease amount of the injection amount is given as the correction coefficient for the base injection amount, but an applicable embodiment is not limited thereto. For example, the decrease amount of the injection amount may be given as the decrease correction amount for the base injection amount Qb. Alternatively, for example, the decrease amount of the injection amount may be given as the decrease amount of "K·KAF·Qb".

The decrease coefficient value KAF0 may not necessarily be a value obtained by reducing fluctuations in the average correction coefficient KAFa. For example, the decrease coefficient value KAF0 may be the value of the feedback correction coefficient KAF before the changeover of the performance flag F to "1".

"As for Feedback Process"

In the foregoing embodiment, the sum of the output of the proportional element, the output of the differential element, and the output of the integral element is used as the correction ratio δ, but an applicable embodiment is not limited thereto. For example, the sum of the output of the proportional element and the output of the integral element may be used as the correction ratio δ.

"As for Decrease Index Value"

In the foregoing embodiment, the stop decrease process is performed when the integrated air amount InGa is smaller than the predetermined value Inth, and the predetermined value Inth is set in accordance with the startup coolant temperature THW0, but an applicable embodiment is not limited thereto. For example, integrated values that increase as the intake air amount Ga increases and that decrease as the startup coolant temperature THW0 lowers may be obtained through map computation, and the stop decrease process may be performed when a value obtained by integrating the integrated values is smaller than a predetermined value. In this manner as well, the stop decrease process can be performed when the integrated air amount is equal to or larger than the predetermined value, and a process of setting the predetermined value to a value that increases as the startup coolant temperature THW0 lowers can be realized.

The setting index value that is an index value of the temperature of the internal combustion engine 10 that serves as an input for variably setting the predetermined value Inth may not necessarily be the startup coolant temperature THW0. For example, the setting index value may be the temperature of lubricating oil in starting up the internal combustion engine 10. It should be noted, however, that the setting itself of the predetermined value Inth variably in accordance with the temperature in starting up the internal combustion engine 10 is not indispensable.

In the foregoing embodiment, the decrease index value for determining whether to carry out the decrease correction or not, and the increase index value that is referred to in determining whether to perform the low-temperature increase process or not are different variables, but an applicable embodiment is not limited thereto. For example, both the index values may be the coolant temperature THW.

For example, the low-temperature increase coefficient Kw may be adopted as the decrease index value, and it may be determined in the processing of S44 whether or not the low-temperature increase coefficient Kw is equal to or larger than the predetermined value.

"As for Predetermined Condition for Permitting Performance of Regeneration Process"

The predetermined condition for permitting the performance of the regeneration process may not necessarily be that exemplified in the foregoing embodiment. For example, as for the two conditions (i) and (ii), the predetermined condition may include only one thereof. Incidentally, the predetermined condition may include conditions other than the foregoing two conditions, or may exclude both the foregoing conditions.

"As for Stop Process"

The stop process may not necessarily be the regeneration process. For example, the stop process may be a process of stopping the supply of fuel to one or some of the cylinders with a view to adjusting the output of the internal combustion engine 10. In this case, the air-fuel ratio of the air-fuel mixture in the other cylinders or the other cylinder may be set to the theoretical air-fuel ratio. Alternatively, the stop process may be, for example, a process of stopping the supply of fuel to one or some of the cylinders when an abnormality occurs therein. Alternatively, the stop process may be, for example, a process of stopping the supply of fuel to only one or some of the cylinders and performing the control of setting the air-fuel ratio of the air-fuel mixture in the other cylinders or the other cylinder to the theoretical air-fuel ratio when the amount of oxygen occluded in the three-way catalyst 32 is equal to or smaller than a prescribed amount. In any case, when the stop process is performed, it is likely to be difficult to carry out the feedback of the air-fuel ratio. Therefore, it is effective to stop the correction coefficient calculation process M12.

"As for Estimation of Deposition Amount"

The process of estimating the deposition amount DPM may not necessarily be that exemplified in FIG. 3. For example, the deposition amount DPM may be estimated based on the difference in pressure between an upstream side and a downstream side of the GPF 34 and the intake air amount Ga. In concrete terms, the deposition amount DPM may be estimated as a value that is larger when the difference in pressure is large than when the difference in pressure is small. Even in the case where the difference in pressure remains unchanged, the deposition amount DPM may be estimated as a value that is larger when the intake air amount Ga is small than when the intake air amount Ga is large.

"As for Aftertreatment Device"

The GPF 34 may not necessarily be the filter on which the three-way catalyst is carried, but may simply be the filter.

Besides, the GPF 34 may not necessarily be provided in the exhaust passage 30 downstream of the three-way catalyst 32. Besides, an after treatment device is not absolutely required to be equipped with the GPF 34. For example, even in the case where the aftertreatment device is constituted only of the three-way catalyst 32, it is effective to perform the processes exemplified in the foregoing embodiment and the modification examples thereof, as long as the temperature of the aftertreatment device needs to be raised at the time of the regeneration process for the three-way catalyst 32.

"As for Control Apparatus"

The control apparatus may not necessarily be equipped with the CPU 72 and the ROM 74 and perform software processes. For example, the control apparatus may be equipped with a dedicated hardware circuit for subjecting at least one or some of the values subjected to the software processes in the foregoing embodiment to hardware processes, such as an ASIC. That is, the control apparatus may be configured as described below in any one of (a) to (c). (a) The control apparatus is equipped with a processing device that performs all the foregoing processes according to programs, and a program storage device for storing the programs, such as a ROM. (b) The control apparatus is equipped with a processing device that performs one or some of the foregoing processes according to programs, a program storage device, and a dedicated hardware circuit that performs the other processes or the other process. (c) The control apparatus is equipped with a dedicated hardware circuit that performs all the foregoing processes. It should be noted herein that the control apparatus may be equipped with a plurality of software execution devices equipped with processing devices and program storage devices, and a plurality of dedicated hardware circuits.

"As for Vehicle"

The vehicle may not necessarily be a series parallel hybrid vehicle, but may be, for example, a parallel hybrid vehicle or a series hybrid vehicle. However, the vehicle may not necessarily be a hybrid vehicle, but may be a vehicle having the internal combustion engine 10 as the only motive power generation device.

What is claimed is:

1. A control apparatus for an internal combustion engine, the control apparatus being applied to an internal combustion engine having a plurality of cylinders and performing a base injection amount calculation process for calculating a base value of an injection amount of fuel injection valves that supply fuel to the cylinders respectively, a correction process for correcting the injection amount from the base value, and an injection valve operation process for operating the fuel injection valves in accordance with an output of the correction process, wherein the correction process includes a low-temperature increase process, a feedback process, and a stop decrease process, the low-temperature increase process is a process of correcting the injection amount in an increasing manner when an increase index value that is an index value of a temperature of the internal combustion engine is smaller than a threshold, the feedback process is a process of correcting the injection amount to control an air-fuel ratio of an air-fuel mixture in the cylinders of the internal combustion engine to a target air-fuel ratio in a feedback manner, and the stop decrease process is a process of correcting the injection amount in a decreasing manner when a decrease index value that is an index value of the temperature of the internal combustion engine is smaller than a predetermined value and the feedback process is stopped.

2. The control apparatus for the internal combustion engine according to claim 1, wherein the stop decrease process is a process of correcting the injection amount in a decreasing manner in accordance with a value of a correction coefficient of the injection amount corrected through the feedback process before stoppage of the feedback process.

3. The control apparatus for the internal combustion engine according to claim 2, the control apparatus further performing an acquisition process for acquiring a value obtained by reducing fluctuations in the correction coefficient before stoppage of the feedback process, wherein the stop decrease process is a process of correcting the injection amount in a decreasing manner in accordance with the value acquired through the acquisition process.

4. The control apparatus for the internal combustion engine according to claim 1, wherein the stop decrease process includes a process of using an integrated air amount from startup of the internal combustion engine as the decrease index value.

5. The control apparatus for the internal combustion engine according to claim 4, wherein the low-temperature increase process is a process of making the amount corrected in an increasing manner larger when the increase index value is small than when the increase index value is large, and the predetermined value is set as a value that is larger when a setting index value that is an index value of the temperature of the internal combustion engine at time of startup is small than when the setting index value at time of startup is large.

6. The control apparatus for the internal combustion engine according to claim 1, the control apparatus further performing a stop process, wherein the stop process is a process of stopping fuel injection by the fuel injection valve of one of the cylinders or the fuel injection valves of some of the cylinders and continuing fuel injection in the other cylinders or the other cylinder, the feedback process is stopped when the stop process is performed, and the stop decrease process is performed when the decrease index value is smaller than the predetermined value during performance of the stop process.

7. The control apparatus for the internal combustion engine according to claim 6, wherein the internal combustion engine is equipped with a catalyst capable of occluding oxygen in an exhaust passage, a rich combustion process for making the air-fuel ratio of the air-fuel mixture in the other cylinders or the other cylinder richer than a theoretical air-fuel ratio is performed when the stop process is performed, and the stop process and the rich combustion process constitute a temperature raising process for raising a temperature of an exhaust system of the internal combustion engine.

* * * * *